US005336292A

United States Patent [19]

Weinl et al.

[11] Patent Number: 5,336,292

[45] Date of Patent: Aug. 9, 1994

[54] TITANIUM-BASED CARBONITRIDE ALLOY WITH WEAR RESISTANT SURFACE LAYER

[75] Inventors: Gerold Weinl, Alvsjo; Marian Mikus, Skarholmen, both of Sweden

[73] Assignee: Sandvik AB, Sandviken, Sweden

[21] Appl. No.: 897,941

[22] Filed: Jun. 15, 1992

[30] Foreign Application Priority Data

Jun. 17, 1991 [SE] Sweden ..... 9101865

[51] Int. Cl.[5] ..... C22C 29/00; B22F 3/00

[52] U.S. Cl. ..... 75/230; 75/243; 75/244; 428/547; 428/552; 428/610; 148/206; 148/207; 419/10; 419/29; 427/585

[58] Field of Search ..... 75/236, 238, 240, 239, 75/242, 246; 148/206, 217, 237, 231; 428/547, 552, 610; 427/585; 419/29, 10

[56] References Cited

U.S. PATENT DOCUMENTS

| | | | |
|---|---|---|---|
| Re. 34,180 | 2/1993 | Nemeth et al. | 428/547 |
| 3,994,692 | 11/1976 | Rudy | 29/182.5 |
| 4,276,096 | 6/1981 | Kolaska et al. | 148/16.6 |
| 4,447,263 | 5/1984 | Sugizawa et al. | 75/233 |
| 4,610,931 | 9/1986 | Nemeth et al. | 428/547 |
| 4,784,923 | 11/1988 | Graham | 428/698 |
| 4,830,930 | 5/1989 | Taniguchi et al. | 428/547 |
| 4,843,039 | 7/1989 | Akesson et al. | 501/87 |
| 4,963,321 | 10/1990 | Saitoh et al. | 419/13 |
| 4,990,410 | 2/1991 | Saitoh et al. | 428/547 |
| 5,181,953 | 1/1993 | Nakano et al. | 75/237 |

OTHER PUBLICATIONS

Kotani Jiro et al, "Wear-Resistant Titanium Carbonitride-Based Cermets for Cutting Tools":, Chemical Abstracts, vol. 114, No. 12, Mar. 25, 1991, Columbus, Ohio, p. 310, Abstract No. 107 310a.

*Primary Examiner*—Donald P. Walsh
*Assistant Examiner*—Ngoclan T. Mai
*Attorney, Agent, or Firm*—Burns, Doane, Swecker & Mathis

[57] ABSTRACT

A sintered body of titanium-based carbonitride alloy according to the invention comprises carbonitride hard constituents in 5-25% binder phase where the hard constituents contain, in addition to Ti, one or more of the metals Zr, Hf, V, Nb, Ta, Cr, Mo and/or W and the binder phase is based on cobalt and/or nickel. The sintered body has at least one outer surface with a $<50\ \mu m$ thick surface layer of a titanium-rich cubic carbonitride. Below this layer there is a $<100\ \mu m$ thick binder phase enrichment zone. The binder phase content can be $>1.2$ of that in the inner part of the body D. Under the binder phase enrichment zone, there is a $<250\ \mu m$ thick binder phase depleted zone C. The binder phase content in this zone has a lowest level $<0.9$ of the binder phase content in the inner part of the body D.

Such sintered bodies are manufactured by heat treatment in an atmosphere of $N_2$ and/or $NH_3$ possibly in combination with at least one of $CH_4$, CO and $CO_2$ at 1100°-1350° C. for 1-25 hours at atmospheric pressure or higher.

12 Claims, 4 Drawing Sheets

4 µm

10 μm

10 μm

TITANIUM-BASED CARBONITRIDE ALLOY WITH WEAR RESISTANT SURFACE LAYER

BACKGROUND OF THE INVENTION

The present invention relates to a sintered body of a titanium-based carbonitride having improved properties particularly when used as an insert material in curing tools for the machining of metals by, for example, turning, milling and drilling, especially under heavy wear conditions.

Titanium-based carbonitride alloys, so-called cermets, are today well established as an insert material in the metal cutting industry and are especially used for finishing. They contain mainly carbonitride hard constituents embedded in a binder phase. The hard constituent grains generally have a complex structure with a core surrounded by a rim of another composition. Their grain size is usually $<2$ μm.

In addition to Ti, other metals of the groups IVa, Va and VIa, i.e., Zr, Hf, V, Nb, Ta, Cr, Mo, and/or W, are normally found in the carbonitride hard constituents but may also be present as carbide and/or nitride hard constituents. The binder phase generally contains cobalt as well as nickel. The amount of binder phase is generally 3–25% by weight.

U.S. Pat. No. 4,447,263 discloses inserts of a titanium-based carbonitride alloy provided with a wear resistant surface layer of carbonitride or oxycarbonitride alone or in combination. The layer is obtained by a heat treatment at 1100°–1350° C. in an atmosphere of $N_2$, CO and/or $CO_2$ at subpressure.

Inserts according to the above-mentioned patent, thus, consist of a brittle layer on a brittle substrate resulting in an inadequate tool life under toughness demanding operations. It has now surprisingly been found that, if the heat treatment is performed at atmospheric pressure, preferably overpressure, an enrichment of binder phase under the above-mentioned surface layer is obtained, which gives improved toughness.

OBJECTS AND SUMMARY OF THE INVENTION

It is an object of this invention to avoid or alleviate the problems of the prior art.

It is also an object of this invention to provide an improved process for making a titanium-based carbonitride alloy with a wear resistant surface layer.

In one aspect of the invention there is provided a sintered body of titanium-based carbonitride alloy comprising mainly carbonitride hard constituents in 5–25% binder phase where the hard constituents contain, in addition to Ti, one or more of the metals Zr, Hf, V, Nb, Ta, Cr, Mo and/or W and the binder phase is based on cobalt and/or nickel, said body having at least one surface with a $<50$ μm thick surface layer containing Ti-N-rich cubic phase below which layer there is a $<100$ μm thick binder phase enrichment zone in which the binder phase content increases to a maximum of $>1.2$ of the binder phase content in the inner part of the body and below said binder phase enrichment zone, a $<250$ μm thick binder phase depleted zone in which the binder phase content has a lowest level of $<0.9$ of the binder phase content in the inner part of the body.

In another aspect of the invention there is provided a method of treating a sintered body of titanium-based carbonitride alloy comprising mainly carbonitride hard constituents in 5–25% binder phase where the hard constituents contain, in addition to Ti, one or more of the metals Zr, Hf, V, Nb, Ta, Cr, Mo and/or W and the binder phase is based on cobalt and/or nickel wherein said sintered body is heat treated in an atmosphere of $N_2$ and/or $NH_3$ at 1100°–1350° C. for 1–25 hours at a pressure at least atmospheric.

In the figures, A(=A1+A2) is the surface layer; B is the binder phase; C is the hard constituent enrichment; D is the unaffected inner part; E is a grain with core-rim; F is the matrix in the surface layer; and G is the Ti-N-rich grains in the binder phase enrichment.

DETAILED DESCRIPTION OF THE PREFERRED EMBODIMENTS OF THE INVENTION

According to the invention there is now provided a sintered body of titanium-based carbonitride alloy containing, in addition to Ti, one or more of the metals Zr, Hf, V, Nb, Ta, Cr Mo and/or W and the binder phase (present in an amount of 5– 25%) is based on cobalt and/or nickel in which preferably $N/(C+N)>0.1$ where C=carbon content and N=nitrogen content. At least one outer surface of the body has a $<50$ μm, preferably 1–35 μm, thick surface layer A containing Ti-N-rich cubic phase formed as a result of the heat treatment. Below this layer there is a $<100$ μm, preferably 10–50 μm, thick binder phase enriched surface zone B also present in the cutting edge, FIGS. 4 and 5. The binder phase content in this zone has a maximum $>1.2$, preferably 1.5–4, times larger than the binder phase content in the inner part of the body D. Below the binder phase enrichment there is a $<250$ μm, preferably 50–150 μm, binder phase depleted zone C. The binder phase content in this zone has a lowest level $<0.9$, preferably $<0.75$, of the binder phase content in the inner part of the body D.

Figure 2:
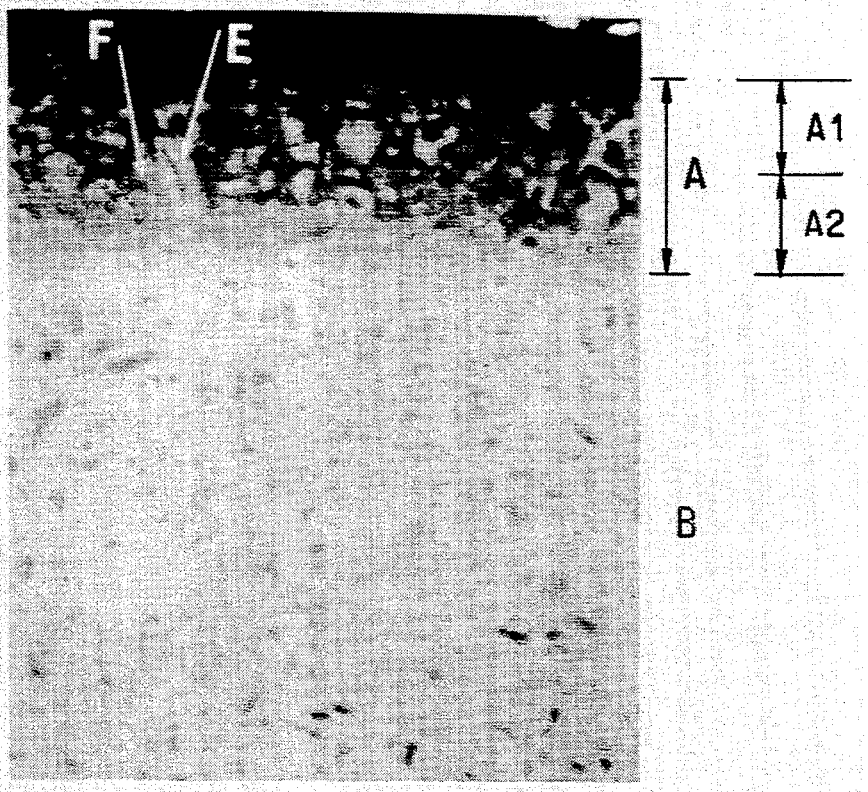
FIG. 2 shows the structure in a cross-section of the surface layer and binder phase enrichment in 2500X (electron optical image) in a body according to the invention.

The surface layer exhibits a complex microstructure, FIG. 2, comprising nitride original grains (after sintering) of which many consist of core-rim E, and a Ti-N-rich cubic phase F forming a more or less interconnecting matrix. In the outer part of the surface layer, A1 in FIG. 2, binder phase is present with a maximum of $<1.2$, preferably $<0.9$, most preferably $<0.6$, of the binder phase content in the inner part of the body D. In the inner part of the surface layer, A2 in FIG. 2, the binder phase content has a minimum of $<0.5$, preferably $<0.3$, of the binder phase content in the inner part of the body D.

The Ti-N-rich cubic phase also contains other elements found in the inner part of the body, e.g., tantalum and vanadium, if present. Tungsten and/or molybdenum, if present, are found mainly in the rims in the core-rim grains. The total content of tungsten and/or molybdenum in the surface layer compared to the inner part of the body is, however, distinctly lower, <0.75, preferably <0.5. The cubic phase can also contain oxygen and carbon. The oxygen content of this phase can be higher than in the inner part of the body D. The carbon content of the cubic phase, on the contrary, is usually lower than in the inner part of the body D. Carbon and/or oxygen and nitrogen can be present evenly distributed in the whole surface layer A or as gradient.

Figure 3:
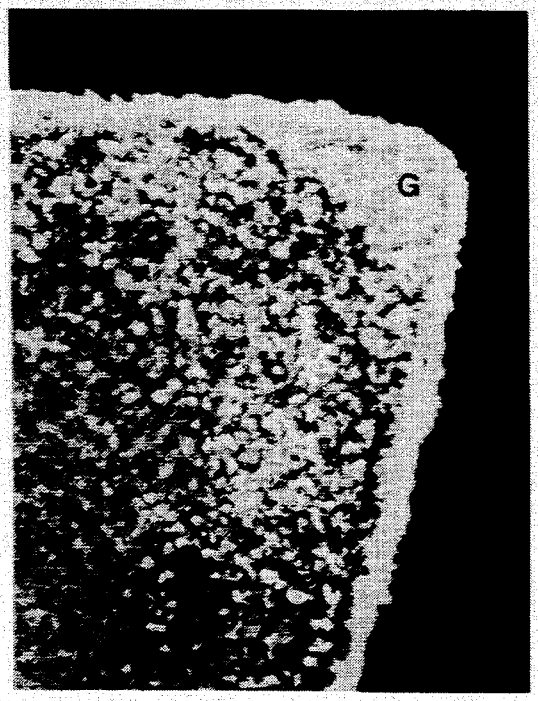
FIG. 3 is a light optical structure image in 1200X of a slightly etched cross-section of a cutting edge of an insert according to the invention.
Figure 4:
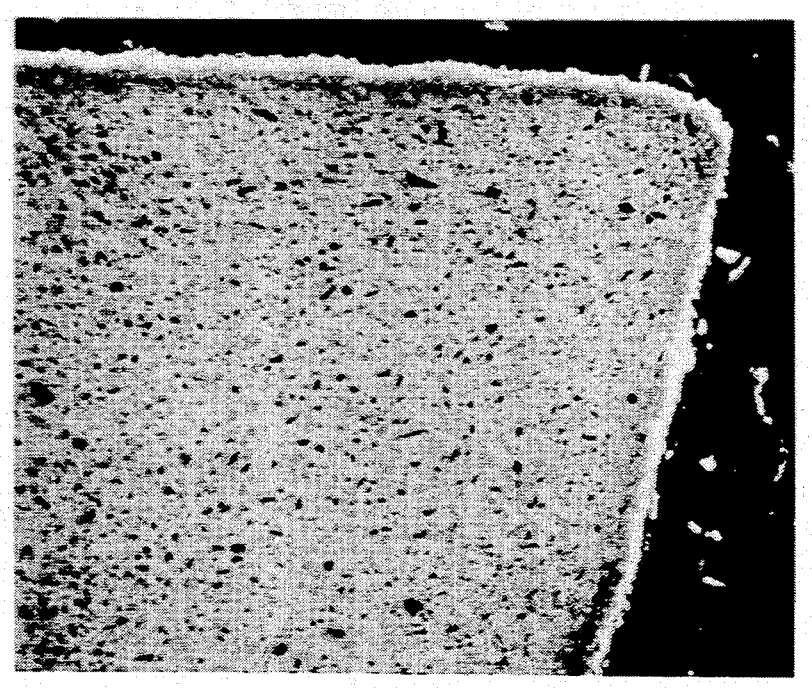
FIG. 4 is an electron optical image in 1000X of a cutting edge according to the invention in cross-section.
Figure 5:
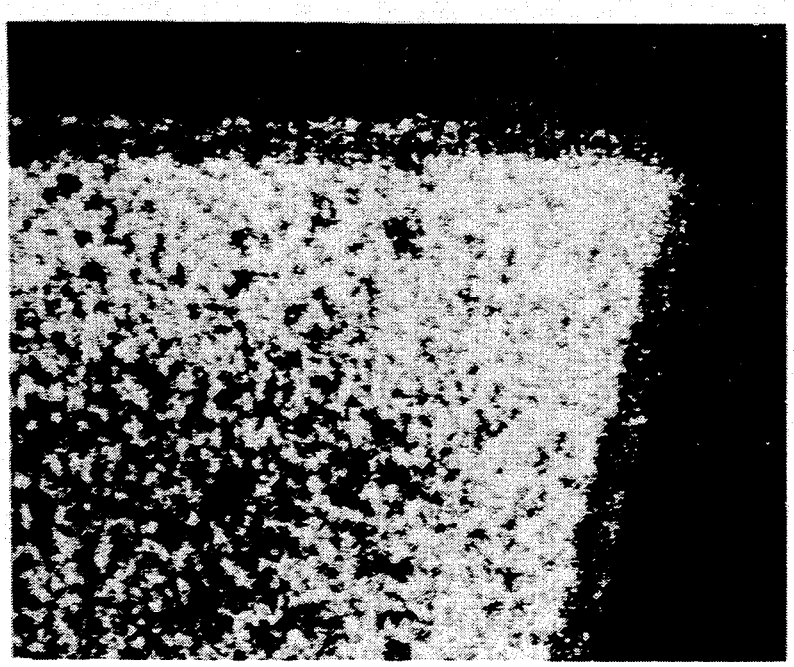
FIG. 5 is a corresponding image of the cobalt-distribution.

Also in the cutting edge itself, the binder phase enrichment is present, FIGS. 4 and 5, which effectively contributes to the increased toughness. In relatively sharp cutting edges, usually used in milling, the hard surface layer becomes thinner in the edge line and, in addition, the Ti-N-rich matrix is present in the form of small grains in a triangular area G, FIG. 3, in the outer part of the binder phase enrichment.

Sintered bodies according to the present invention may further be provided with thin wear resistant coatings, preferably of oxide, known in the art.

Bodies of titanium-based carbonitride alloy according to the present invention are manufactured by heat treatment of sintered bodies of the composition described above, mechanically treated to finished dimension, if desired, in an atmosphere of $N_2$ and/or $NH_3$ possibly in combination with at least one of $CH_4$, CO and $CO_2$ at 1100°-1350° C. for 1-25 hours at atmospheric pressure or higher, preferably >1.1 bar. By varying the contents of the ingoing gases during different periods of that treatment, the distribution of carbon, nitrogen and/or oxygen can be influenced.

After the heat treatment, the bodies may be ground on at least one of its surfaces and, if desired, coated with a metal carbide, nitrite, oxide, mixtures and compounds thereof by CVD- or PVD-technique according to known techniques.

Sintered bodies according to the present invention are useful as inserts in tools for machining, such as turning and milling and as wear parts such as seal rings, etc.

The invention is additionally illustrated in connection with the following Example which is to be considered as illustrative of the present invention. It should be understood, however, that the invention is not limited to the specific details of the Example.

EXAMPLE

Figure 1A:
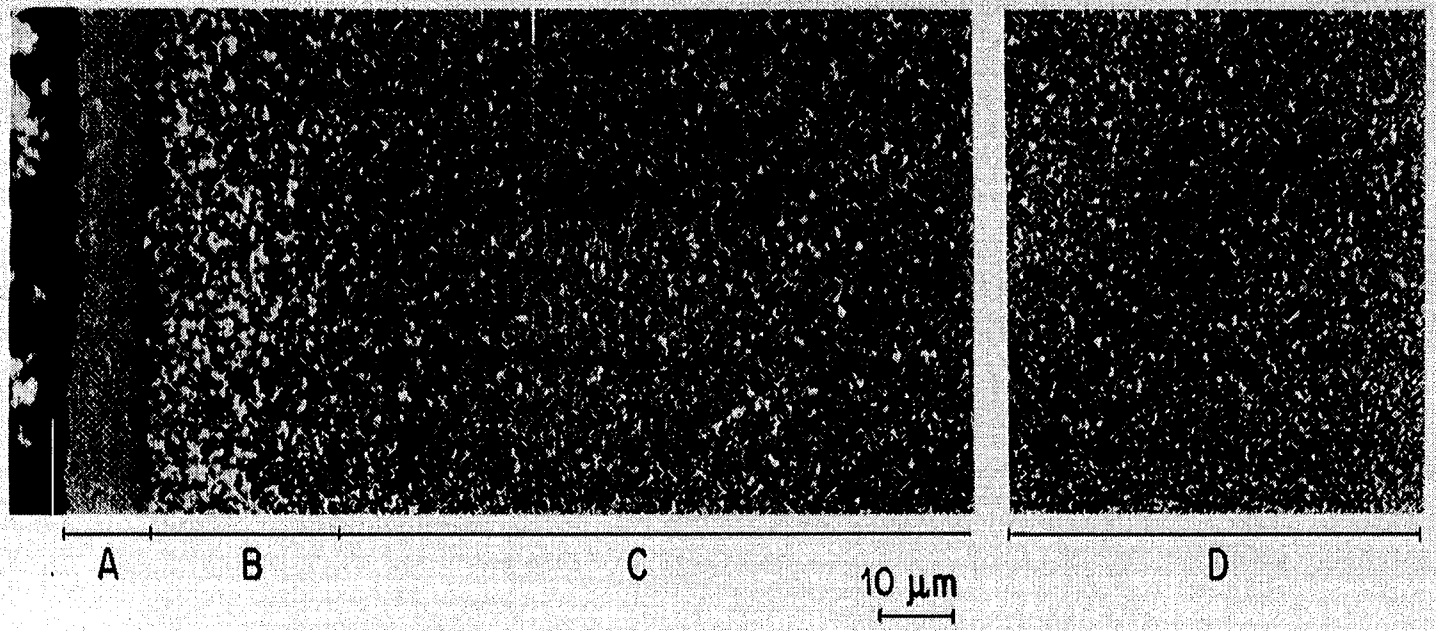
FIG. 1A shows the microstructure in 1000X (light optical image)
Figure 1B:
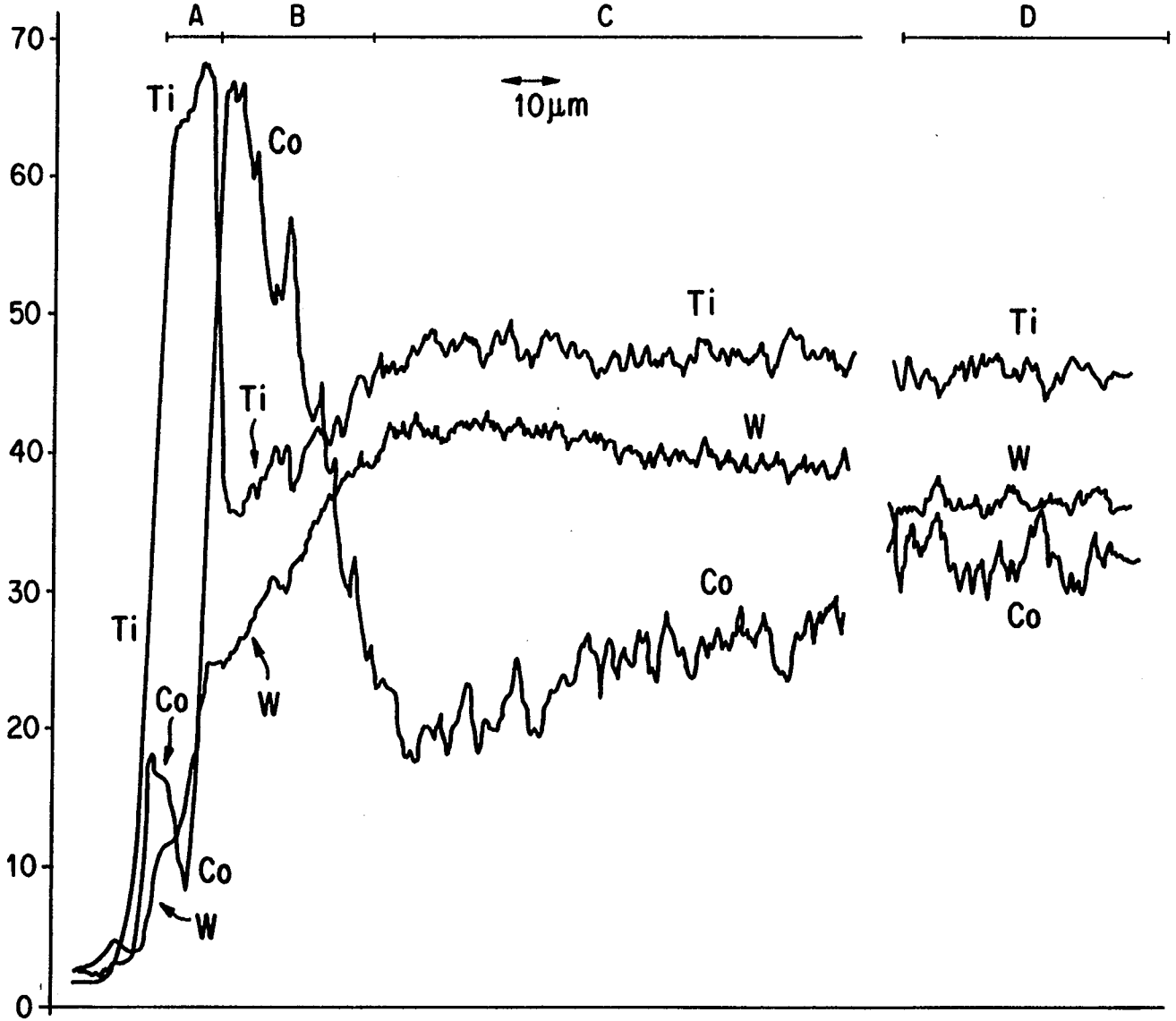
FIG. 1B shows the dement distribution in a cross-section of the surface zone in a body according to the invention.

Turning inserts of type TNMG 160408-QF were manufactured with the following composition in weight-%: TiN 20, TiC 29, TaC 6.3, $Mo_2C$ 9.3, WC 15.9, VC 3.9, Co+Ni, 16.2. After sintering in 10 mbar protective atmosphere (Ar) at 1430° C. for 90 minutes, a mechanical surface treatment was performed to final dimension. The inserts were thereafter heat treated according to the invention in $N_2$ atmosphere at 1300° C. for 15 hours at 1200 mbar whereby a surface structure according to FIG. 1 was obtained.

The inserts were tested in a turning operation with the following cutting data:

| | |
|---|---|
| Work piece: | SS 2541 |
| Cutting depth: | 2 mm |

-continued

| | |
|---|---|
| Feed: | 0.2 mm |
| Speed: | 3000 m/min |

The flank wear, VB, was measured continuously every 5th minute. Three tests were performed. As tool life criterion, VB >0.3 mm was chosen for a reference with the same composition but without heat treatment according to the present invention. For the inserts according to the present invention, the following data for VB were obtained after about 20 minutes engagement time where VB for the reference was >0.3 mm.

| Test | VB, mm |
|---|---|
| 1 | 0.17 |
| 2 | 0.20 |
| 3 | 0.18 |

As a further reference inserts according to the earlier mentioned U.S. Pat. No. 4,447,263, were used. In all of the tests, these inserts fractured after 5-12 minutes engagement time. The reason to fracture was brittle fracture without any previous appreciable wear, i.e., lack of toughness.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. The sintered body of titanium-based carbonitride alloy comprising mainly carbonitride hard constituents in 5-25% binder phase where the hard constituents contain, in addition to Ti, one or more of the metals Zr, Hf, V, Nb, Ta, Cr, Mo and/or W and the binder phase is based on cobalt and/or nickel, said body having at least one surface with a <50 μm thick surface layer containing Ti-N-rich cubic phase below which layer there is a <100 μm thick binder phase enrichment zone in which zone the binder phase content is greater than the binder phase content of the body as a whole, the binder phase content in said zone increasing to a value of >1.2 of the binder phase content in the inner part of the body and below said binder phase enrichment zone, a <250 μm thick binder phase depleted zone in which zone the binder phase content is less than the binder phase content of the body as a whole, the binder phase content in said zone decreasing to a value of <0.9 of the binder phase content in the inner part of the body.

2. A sintered body according to claim 1 wherein the alloy further contains N and C in the ratio N/(N+C)>0.1.

3. A sintered body according to claim 2 wherein said body is further provided with at least one wear resistant coating deposited by CVD- or PVD-technique.

4. A sintered body according to claim 1 wherein the surface layer containing the Ti-N-rich cubic phase is 1-35 μm thick.

5. A sintered body according to claim 4 wherein the binder phase enriched surface zone below the Ti-N-rich cubic phase is 10-50 μm thick.

6. A sintered body according to claim 5 wherein the maximum binder phase content in said binder phase enriched surface zone is 1.5–4 times the binder phase content in the inner part of the body.

7. A sintered body according to claim 6 wherein the binder phase depleted zone below the binder phase enriched zone is 50–150 μm thick.

8. A sintered body according to claim 7 wherein the binder phase content in said binder phase depleted zone decreases to a value of <0.75 of the binder phase content in the inner part of the body.

9. A method of treating a sintered body of titanium-based carbonitride alloy comprising mainly carbonitride hard constituents in 5–25% binder phase where the hard constituents contain, in addition to Ti, one or more of the metals Zr, Hf, V, Nb, Ta, Cr, Mo and/or W and the binder phase is based on cobalt and/or nickel wherein said sintered body is heat treated in an atmosphere of $N_2$ and/or $NH_3$ at 1100°–1350° C. for 1–25 hours at atmospheric or higher pressure.

10. A method of claim 9 wherein said heat treating atmosphere further contains at least one of $CH_4$, CO and $CO_2$.

11. A method of claim 9 wherein said pressure is greater than 1.1 bar.

12. A method of claim 10 wherein said treated body is thereafter coated on at least one surface with a metal carbide, nitride, oxide, mixtures and compounds thereof by a CVD- or PVD-technique.

* * * * *